United States Patent [19]

Kannapell

[11] 4,027,654

[45] June 7, 1977

[54] DAMPER ASSEMBLY FOR HIGH TEMPERATURE OR CORROSIVE GASES

[75] Inventor: David H. Kannapell, Prospect, Ky.

[73] Assignee: American Air Filter Company, Inc., Louisville, Ky.

[22] Filed: Dec. 4, 1975

[21] Appl. No.: 637,720

[52] U.S. Cl. ..... 126/285 R; 110/163; 110/173 R; 122/498; 137/310

[51] Int. Cl.[2] ..... F23L 3/00; F23L 11/00; F23L 13/04

[58] Field of Search ..... 122/498; 110/163, 173 R; 137/310, 624 A; 126/285 R, 285 A

[56] References Cited

UNITED STATES PATENTS

| | | | |
|---|---|---|---|
| 1,868,253 | 7/1932 | Rackebrant | 110/173 R |
| 1,962,336 | 6/1934 | Williams | 126/285 A |
| 2,475,102 | 7/1949 | Longacre | 122/498 |
| 2,659,361 | 11/1953 | Holbrook | 110/173 R |
| 2,705,477 | 4/1955 | Braun | 110/173 R |
| 2,720,150 | 10/1955 | Lyman | 137/625.4 X |

*Primary Examiner*—Ronald C. Capossela

[57] ABSTRACT

A damper assembly for high temperature or corrosive gases including a flow through housing with a damper blade disposed therein, the damper blade including a metallic plate member attached to a transversely extending support member which extends through openings in the side walls of the housing. The plate member includes means for receiving refractory thereon wherein the refractory substantially covers the plate member and is divided into a plurality of preselected sections, each section being separated by a material having a relatively low disintegrating temperature whereby upon initial heating of the damper assembly to temperatures higher than the disintegrating temperature of the relatively low disintegrating material, the said material disintegrates thereby leaving spacing in the refractory for expansion and contraction over a wide range of temperatures.

9 Claims, 2 Drawing Figures

DAMPER ASSEMBLY FOR HIGH TEMPERATURE OR CORROSIVE GASES

BACKGROUND OF THE INVENTION

Figure 1:
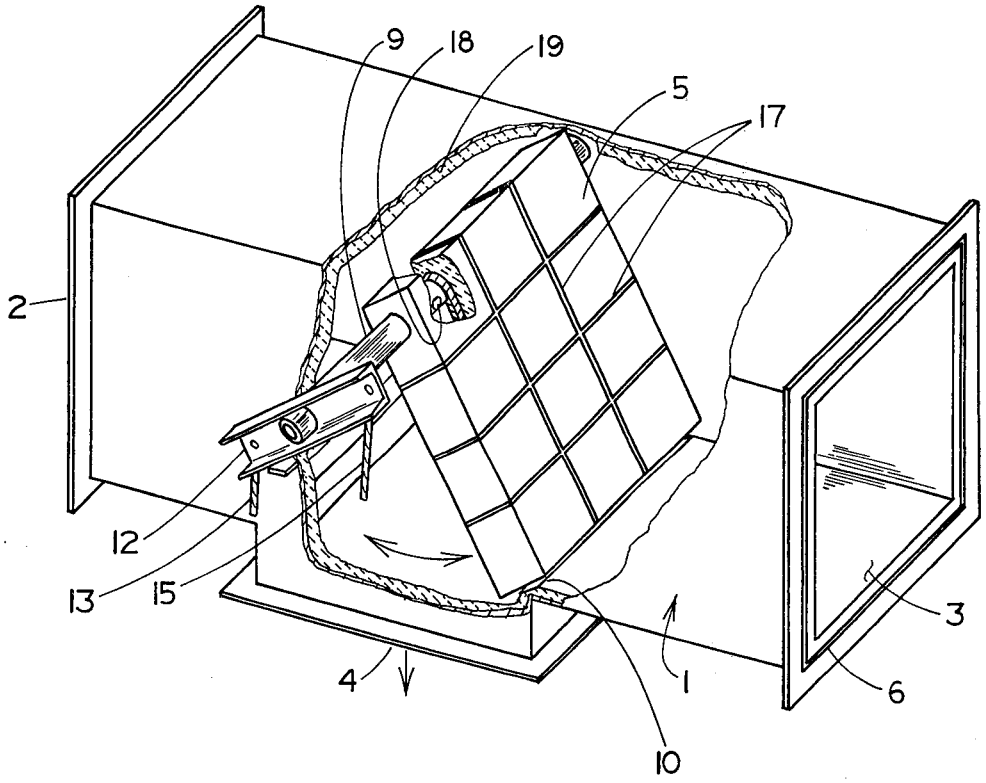

This invention relates to an improved damper assembly construction for high temperature or corrosive gases and particularly relates to an improved damper assembly with means therein for permitting expansion and contraction of the damper blade over a wide temperature range.

During the operation of blast furnaces, cupolas, and other types of furnaces used in the metal producing industry, hot gases emanate from the mouth of the furnaces and are usually caught in fume hoods or the like wherein blowers in flow communication with the fume hood remove the fumes emanating from the furnaces thereby preventing pollution of the air in the metal making area. These fumes contain a large percentage of particulate material and are received in the fume removal system at temperatures of as high as and sometimes in excess of 2000° F. In these fume removal systems, damper assemblies are utilized for regulating the flow through the system and these damper assemblies are subjected to a wide range of temperatures. In the prior art, these assemblies are generally cooled by water or other means in order to prevent warping, cracking and excessive oxidation with failure of operation resulting due to the high temperature which such damper assemblies are required to withstand. Other means which have been utilized to protect the damper blade over a wide temperature range include blades made up of a plurality of metallic sections arranged to permit freedom of expansion and contraction of each of the sections in every direction, all of the parts so co-related and joined as to form a substantially gas tight barrier. However, in the case of the water cooled damper assemblies and in the metallic assemblies having means for expansion and contraction, cost of the dampers are quite expensive and weight becomes a problem. And, particularly in the case of the metallic dampers, very specific and high cost heavy materials of construction are required.

SUMMARY OF THE INVENTION

In the present invention, it is recognized that it is desirable to provide a damper assembly for use in hot gas streams which is relatively inexpensive, easily constructed, and easily and quickly operable. Furthermore, it is recognized that it is desirable to provide a damper assembly which may be utilized over a wide range of temperatures and is not subject to failure after a prolonged period of time.

The present invention advantageously provides a straightforward arrangement for a damper assembly for use in hot gas streams and includes a refractory blade on a metallic base wherein the refractory blade is sectioned with a relatively low temperature disintegrating material being utilized to separate each section of the damper blade so that upon initial heat up of the blade the low temperature disintegrating material disintegrates leaving spaces between the sections of the refractory thereby allowing for expansion and contraction of the refractory over a wide range of temperatures.

Various other features of the present invention will become obvious to those skilled in the art upon reading the disclosure set forth hereinafter.

More particulary, the present invention provides a damper assembly comprising a flow through housing having a flow through inlet and a flow through outlet; a metallic plate member disposed within the housing and attached to a transversely extending movable support member, the support member extending through aligned openings in the side walls of the housing; the plate member including means for receiving refractory thereon; and, the refractory substantially covering the plate member, the refractory being divided into a plurality of preselected sections, each section being defined by a material having a relatively low disintegrating temmperature whereby upon initial heating of the assembly, the low temperature disintegrating material disintegrates thereby leaving spacing in the refractory for expansion at high temperature.

It is to be understood that the description of the examples of the present invention given hereinafter are not by way of limitation. Various modifications within the scope of the present invention will occur to those skilled in the art upon reading the disclosure set forth hereinafter.

Figure 2:
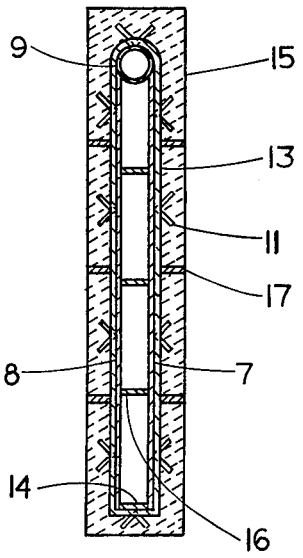

Referring to the drawing:

FIG. 1 is a perspective view, with selected portions cut-away, of a preferred damper assembly of the present invention; and, FIG. 2 is a side view of the damper blade in FIG. 1.

In FIG. 1 the housing 1 having two opposed flow through inlets 2 and 3 and a flow through outlet 4 includes a damper assembly 5 therein. The housing 1 is generally fabricated with a steel outer shell 6 and a high temperature refractory inner shell 19, the refractory being affixed to the steel shell by any well known means.

The damper assembly 5 includes a pair of flat metal plate members 7 and 8 fixedly attached to a transversely extending member 9, exemplified as a pipe, which extends through opposed aligned openings in the side walls of the housing 1. Pipe member 9 is provided with openings 18 therein at preselected positions between the plate members 7 and 8 for relieving the pressure build-up between plate 7 and 8 during heat-up. Furthermore, supports 16 extending through aligned apertures in plates 7 and 8 are provided to prevent warping during heat-up and cool-down. Supports 16 are provided at several selected positions of the plates and are exemplified as stainless steel rods which are weldably attached to the plates. At the end of the plate members 7 and 8 opposed to pipe member 9 a transversely extending flat member 14 is welded thereto.

The transversely extending pipe member 9 is attached to a damper blade arm 12 which includes a pair of cables 13 and 15 extending downwardly therefrom, the cables being utilized for rotating the damper from one position to another. Damper blade arm 12 is a channel-shaped member having an opening in the center thereof to receive one end of the pipe member 9 therethrough.

The flat plate members 7 and 8 include a plurality of outwardly extending V-shaped metallic members 11 attached thereto, the members 11 being small sections of refractory anchors welded to the plates 7 and 8 at preselected positions thereon. Moreover, it is realized that outwardly extending members 11 may also be short sections of rods, plates, or the like which are fixedly attached to the flat plate members 7 and 8. A silica-alumina fibrous blanket 13 substantially covers the plate members 7 and 14 with the V-shaped members 11 extending through the blanket 13. The fibrous blanket 13, exemplified as Kaowool manufactured by Babcock and Wilcox, is generally attached by adhesive means having high temperature resistance.

Substantially covering the Kaowool blanket 13 and the plate members 7, 8 and 14 is a high temperature refractory material 15, exemplified as Kaocrete which is manufactured by Bablock and Wilcox. The refractory material 15 is sectionalized into a preselected number of sections with a plurality of low temperature disintegratable board members 17 extending transversely and longitudinally at preselected sections of the blade 5. The low temperature disintegratable members 17 are exemplified as Masonite board, Masonite boards being used as they have been found to be sturdy and burn out or disintegrate at temperatures below the temperatures for expansion of the high temperature refractory material.

Generally, the inside periphery of the housing 1 is slightly larger than the peripheral edge of the blade 5 thereby providing an expansion gap, designated by the numeral 10, which allows for expansion of the peripheral edge of the blade 5 at high temperatures.

In the operation of the damper assembly of the present invention the opposed openings 2 and 3 of the housing 1 are in fluid communication with a fume hood, not shown, or other gas receiving means with the outlet being in flow communication with a cleaning system, not shown, which may be an electrostatic precipitator, a wet scrubber, or other well known gas cleaning devices or systems. In the initial operation of the damper assembly the damper blade 5 is positioned by the damper blade arm 12 to a position for allowing the passage of dirty gases from a preselected cupola or the like wherein the hot gases coming into the housing heat up the damper blade 5 thereby disintegrating the low temperature disintegratable material leaving the refractory of the blade 5 in a plurality of sections with spacings disposed between the sections, the spacings being formed by the disintegration of the low temperature disintegratable material. The hot gases continue to heat up the damper blade 5 wherein the refractory material expands into the spacings or voids left by the burn out of the disintegratable material. When the fumes or other hot dirty or corrosive gases are discontinued, the refractory then contracts with the preselected spaces being left on the face of the blade to allow for expansion and contraction upon further use of the blade.

It will be realized that various changes may be made to the specific embodiment shown and described without departing from the principles of the present invention.

What is claimed is:

1. A damper assembly comprising: a flow through housing having a flow through inlet and a flow through outlet; a pair of metallic plate members disposed within the housing and attached on opposite sides to a transversely extending movable support member having pressure relieving means therein, the support member extending through aligned openings in the sidewalls of the housing; said plate members including means for receiving refractory thereon; a refractory substantially covering said plate members, said refractory being divided into a plurality of preselected sections; and, a material having a relatively low disintegrating temperature disposed between adjacent sections of said refractory whereby upon initial heating of the assembly said low temperature disintegrating material disintegrates thereby leaving spacing in the refractory for expansion and contraction over a wide temperature range.

2. The damper assembly of claim 1 wherein the flow through inlet is a pair of opposed flow through inlets, each inlet being in communication with a dirty gas source.

3. The damper assembly of claim 1 including a high temperature fibrous material disposed between said plate members and said refractory, said movable support member being a hollow member with at least one end opening and includes at least one aperture in the wall thereof.

4. The damper assembly of claim 1 wherein said means for receiving refractory thereon includes a plurality of V-shaped outwardly extending portions fixedly attached to said plate members.

5. The damper assembly of claim 4 wherein said V-shaped members are short sections of refractory anchors attached to said plate members.

6. The damper assembly of claim 5 wherein said refractory anchors are welded to said plate members.

7. The damper assembly of claim 5 wherein said refractory anchors are metallic.

8. The damper assembly of claim 1 including a spacing between said damper blade and said housing.

9. The damper assembly of claim 1 wherein Masonite is said low temperature disintegratable material.

* * * * *